US009410379B2

(12) United States Patent
Silva

(10) Patent No.: US 9,410,379 B2
(45) Date of Patent: Aug. 9, 2016

(54) DOWNHOLE CUTTING TOOL

(71) Applicant: National Oilwell DHT, L.P., Conroe, TX (US)

(72) Inventor: Roger H. Silva, Spring, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 628 days.

(21) Appl. No.: 13/728,435

(22) Filed: Dec. 27, 2012

(65) Prior Publication Data

US 2013/0161099 A1 Jun. 27, 2013

Related U.S. Application Data

(60) Provisional application No. 61/580,443, filed on Dec. 27, 2011.

(51) Int. Cl.

| | |
|---|---|
| ***E21B 10/26*** | (2006.01) |
| ***E21B 17/10*** | (2006.01) |
| *E21B 7/00* | (2006.01) |
| *E21B 10/30* | (2006.01) |

(52) U.S. Cl.

CPC ..... *E21B 10/26* (2013.01); *E21B 17/1078* (2013.01); *E21B 7/00* (2013.01); *E21B 10/30* (2013.01)

(58) Field of Classification Search

CPC ..... E21B 10/26; E21B 10/28; E21B 17/10; E21B 17/1057; E21B 17/1078; E21B 17/1085; E21B 10/30; E21B 17/00

See application file for complete search history.

(56) References Cited

U.S. PATENT DOCUMENTS

| | | | | |
|---|---|---|---|---|
| 2,548,724 A | | 4/1951 | Jones | |
| 3,237,705 A | * | 3/1966 | Williams, Jr. | E21B 10/26 175/406 |
| 3,848,683 A | | 11/1974 | Persson | |
| 4,739,843 A | | 4/1988 | Burton | |

(Continued)

FOREIGN PATENT DOCUMENTS

| | | |
|---|---|---|
| CN | 1711404 A | 12/2005 |
| CN | 1784533 A | 6/2006 |

(Continued)

OTHER PUBLICATIONS

ReedHycalog Flyer entitled "Concentric and Eccentric String Hole Opening Solutions," dated 2006 (3 p.).

(Continued)

*Primary Examiner* — Robert E Fuller
*Assistant Examiner* — Christopher Sebesta
(74) *Attorney, Agent, or Firm* — Conley Rose, P.C.

(57) ABSTRACT

A tool for reaming a borehole includes a tubular body having a central axis, an uphole reamer section mounted to the body, and a downhole reamer section mounted to the body. Each reamer section includes a first blade extending radially from the body. Each blade has an uphole end, a downhole end opposite the uphole end, and a formation-facing surface. The formation facing surface of the first blade of the uphole reamer section is disposed at a radius R1 that increases moving from the uphole end to the downhole end. The formation facing surface of the first blade of the downhole reamer section is disposed at a radius R1' that decreases moving from the uphole end to the downhole end. The tool also includes a cutter element mounted to the formation facing surface of the first blade of each reamer section.

19 Claims, 7 Drawing Sheets

(56) References Cited

U.S. PATENT DOCUMENTS

| | | | | |
|---|---|---|---|---|
| 5,341,888 | A * | 8/1994 | Deschutter | 175/323 |
| 5,992,548 | A | 11/1999 | Silva et al. | |
| 6,401,820 | B1 | 6/2002 | Kirk et al. | |
| 6,913,098 | B2 | 7/2005 | Fielder et al. | |
| 8,162,081 | B2 | 4/2012 | Ballard et al. | |
| 8,813,877 | B1 | 8/2014 | Short et al. | |
| 2001/0004536 | A1 | 6/2001 | Ikegami | |
| 2002/0092378 | A1 | 7/2002 | Fielder et al. | |
| 2002/0125047 | A1 * | 9/2002 | Beaton | 175/406 |
| 2004/0099448 | A1 | 5/2004 | Fielder et al. | |
| 2005/0092526 | A1 | 5/2005 | Fielder et al. | |
| 2007/0005316 | A1 | 1/2007 | Paez | |
| 2008/0047754 | A1 | 2/2008 | Evans et al. | |
| 2010/0051349 | A1 * | 3/2010 | Ballard et al. | 175/57 |
| 2010/0078216 | A1 | 4/2010 | Radford et al. | |
| 2010/0089659 | A1 * | 4/2010 | Chafai | 175/385 |
| 2010/0096189 | A1 | 4/2010 | Salzer, III et al. | |
| 2010/0326738 | A1 * | 12/2010 | Boulet | 175/324 |
| 2012/0255786 | A1 * | 10/2012 | Isenhour | E21B 10/26 175/57 |

FOREIGN PATENT DOCUMENTS

| | | | |
|---|---|---|---|
| CN | 101052779 | A | 10/2007 |
| CN | 201034015 | Y | 3/2008 |
| CN | 201436365 | U | 4/2010 |
| GB | 2441214 | A | 2/2008 |
| GB | 2464191 | A | 4/2010 |
| WO | 2007133739 | A2 | 11/2007 |
| WO | 2010044767 | A1 | 4/2010 |

OTHER PUBLICATIONS

PCT/US2012/071808 International Search Report and Written Opinion dated Apr. 9, 2014 (20 p.).

United Kingdom Patent Application No. 1410357.6 Search and Examination Report dated Nov. 10, 2015 (3 pages).

Canadian Patent Application No. 2,859,892 Office Action dated Aug. 24, 2015 (4 pages).

Chinese Patent Application No. 201280065251.7 Office Action dated Jun. 24, 2015 (11 pages).

* cited by examiner

DOWNHOLE CUTTING TOOL

CROSS-REFERENCE TO RELATED APPLICATIONS

This application claims benefit of U.S. provisional patent application Ser. No. 61/580,443 filed Dec. 27, 2011, and entitled "Downhole Cutting Tool," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The present invention relates generally to downhole drilling operations. More particularly, the invention relates to tools for drilling boreholes. Still more particularly, the invention relates to reamer tools for enlarging boreholes during drilling operations.

2. Background of the Technology

An earth-boring drill bit is connected to the lower end of a drill string and is rotated by rotating the drill string from the surface, with a downhole motor, or by both. With weight-on-bit (WOB) applied, the rotating drill bit engages the formation and proceeds to form a borehole along a predetermined path toward a target zone.

In drilling operations, costs are generally proportional to the length of time it takes to drill the borehole to the desired depth and location. The time required to drill the well, in turn, is greatly affected by the number of times downhole tools must be changed or added to the drillstring in order to complete the borehole. This is the case because each time a tool is changed or added, the entire string of drill pipes, which may be miles long, must be retrieved from the borehole, section-by-section. Once the drill string has been retrieved and the tool changed or added, the drillstring must be constructed section-by-section and lowered back into the borehole. This process, known as a "trip" of the drill string, requires considerable time, effort and expense. Since drilling costs are typically on the order of thousands of dollars per hour, it is desirable to reduce the number of times the drillstring must be tripped to complete the borehole.

During oil and gas drilling operations, achieving good borehole quality is also desirable. However, achieving good borehole quality when drilling long horizontal boreholes can be particularly challenging. In particular, to keep the borehole path as close as possible to horizontal, the driller may have to periodically change the direction of the borehole path because gravity has a tendency to cause the drill bit drop slightly below horizontal. Consequently, the driller must make corrections to lift the drill bit back up to horizontal with a directional motor or rotary steerable assembly. Unfortunately, these repeated corrections can result in the formation of ledges and/or sharp corners in the borehole that interfere with the passage of subsequent tools therethrough.

A reamer can be used to remove ledges and sharp corners in the borehole. For a non-expanding reamer, the diameter of the reamer is limited by the diameter of the casing in the borehole that the drill bit and reamer must pass through. If a concentric non-expanding reamer having the same or smaller diameter than the drill bit is used with the drill bit, the reamer will generally follow the path of the drill bit and may not be effective in removing the ledges and/or sharp corners. An eccentric reamer reams the borehole to a diameter that is larger than the diameter of the drill bit and is typically effective in removing ledges and sharp corners. Most conventional eccentric reamers have a plurality of straight circumferentially-spaced blades lined with cutter elements designed to engage and shear the borehole sidewall. The blades are non-uniformly distributed about the tool, and thus, occupy less than the total circumference of the tool, thereby making the reamer eccentric.

Conventional practice is not to use an eccentric reamer with a drill bit when drilling a new section of the borehole for fear of causing damage to the casing and/or cutter elements on the reamer blades. Consequently, after drilling a new section of the borehole, the driller will make a dedicated trip out of the borehole to couple an eccentric reamer to the drill bit and then trip back into the borehole with the drill bit and reamer in order to ream the previously created section of borehole. Alternately, the driller may complete drilling of the new section with the drill bit alone, trip out of the borehole, and then return into the borehole with the eccentric reamer to ream the hole. However, in both cases, an additional trip of the drillstring is required to ream the borehole.

During drilling operations, the drill bit may be rotated from the surface (e.g., with a top drive or rotary table) and/or rotated with a downhole mud motor. In drilling operations where the drill bit is rotated solely with the downhole mud motor (i.e., when sliding), an eccentric reamer is typically not used behind the mud motor. In particular, when sliding, the eccentric reamer does not rotate, and thus, cannot open the hole. Further, since an eccentric reamer is typically used with a drill bit having a diameter smaller than the inner diameter of the casing string (to allow the reamer to pass therethrough), a non-rotating eccentric reamer cannot pass through a borehole formed by such a drill bit.

Accordingly, there remains a need in the art for improved eccentric reamers for smoothing the profile of a borehole during drilling operations by removing ledges and sharp corners along the borehole sidewall. Such improved eccentric reamers would be particularly well-received if they were suitable for use in connection with a drill bit drilling a new section of borehole, as well for use in connection with drill bits rotated solely with downhole motors.

BRIEF SUMMARY OF THE DISCLOSURE

These and other needs in the art are addressed in one embodiment by a tool for reaming a borehole. In an embodiment, the tool comprises a tubular body having a central axis, a first end, and a second end opposite the first end. In addition, the tool comprises an uphole reamer section mounted to the body and a downhole reamer section mounted to the body and axially positioned below the uphole reamer section. Each reamer section includes a first blade extending radially from the body. Each blade has an uphole end, a downhole end opposite the uphole end, a formation-facing surface extending from the uphole end to the downhole end, and a forward-facing surface extending radially from the body to the formation-facing surface. The formation facing surface of the first blade of the uphole reamer section is disposed at a radius R1 measured perpendicularly from the central axis, wherein the radius R1 increases moving from the uphole end to the downhole end of the first blade of the uphole reamer section. The formation facing surface of the first blade of the downhole reamer section is disposed at a radius R1' measured perpendicularly from the central axis, wherein the radius R1' decreases moving from the uphole end to the downhole end of the downhole reamer section. Further, the tool comprises a cutter element mounted to the formation facing surface of the first blade of each reamer section. The cutter element mounted to the first blade of the uphole reamer section extends to a radius relative to the central axis that is less than or equal to the radius R1 at the downhole end of the first blade of the uphole reamer section, and the cutter element mounted to the first blade of the downhole reamer section extends to a radius relative to the central axis that is less than or equal to the radius R1' at the uphole end of the first blade of the downhole reamer section.

These and other needs in the art are addressed in another embodiment by a system for drilling a borehole in an earthen formation. In an embodiment, the system comprises a drillstring having a central axis, an uphole end, and a downhole end. In addition, the system comprises a drill bit disposed at the downhole end of the drillstring coaxially aligned with the drillstring. The drill bit is configured to rotate about the central axis in a cutting direction to drill the borehole to a diameter D1. Further, the system comprises a first reamer section mounted to the drillstring between the drill bit and the uphole end. The first reamer section is configured to rotate about the central axis in the cutting direction to ream the borehole to a diameter D2 that is greater than diameter D1. The first reamer section includes a pair of first blades and a pair of second blades, wherein the blades of the first reamer section are uniformly circumferentially spaced with the first blades circumferentially adjacent each other and the second blades circumferentially adjacent each other. Each blade has an uphole end, a downhole end opposite the uphole end, and a formation-facing surface extending from the uphole end to the downhole end. The formation facing surface of each first blade is disposed at a radius R1 relative to the central axis, wherein the radius R1 of the formation facing surface of each first blade decreases moving from the uphole end to the downhole end. Each second blade extends radially to a maximum radius R2 relative to a reamer axis that is parallel to and radially offset from the central axis, wherein the maximum radius R2 that is less than the radius R1 at the downhole end of each first blade. Still further, the system comprises a plurality of cutter elements mounted to the formation facing surface of each of the first blades, wherein each cutter element extends to a radius relative to the central axis that is less than or equal to the radius R1 at the uphole end of each of the first blades of the first reamer section. Each cutter element has a forward-facing cutting face relative to the cutting direction.

These and other needs in the art are addressed in another embodiment by a method for drilling a borehole. In an embodiment, the method comprises coupling a drill bit to a lower end of a drillstring. In addition, the method comprises coupling a reaming tool to the drillstring between the drill bit and an uphole end of the drillstring, wherein the reaming tool includes a tubular body having a central axis and a downhole eccentric reamer section extending radially from the body; wherein the downhole eccentric reamer section has a pass through diameter D1'. The downhole reamer section is configured to rotate about the central axis of the tubular body in a cutting direction to ream the borehole to a diameter D2. The downhole eccentric reamer section further comprises a cutting blade extending radially from the tubular body, the cutting blade having an uphole end, a downhole end, and a formation-facing surface disposed at a radius R1 measured radially from the central axis, wherein the radius R1 decreases moving from the uphole end to the downhole end. In addition, the downhole eccentric section comprises a plurality of cutter elements mounted to the formation facing surface of the cutting blade, wherein each cutter element extends to a radius relative to the central axis that is less than or equal to the radius R1 of the formation facing surface at the uphole end of the cutting blade. Further, the method comprises lowering the downhole eccentric reamer section through a casing having a central axis and an inner diameter $D_i$ that is greater than or equal to the pass through diameter D1'. The inner diameter $D_i$ is less than the diameter D2. Still further, the method comprises offsetting the central axis of the tubular body from the central axis of the casing while lowering the downhole eccentric reamer section through the casing.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
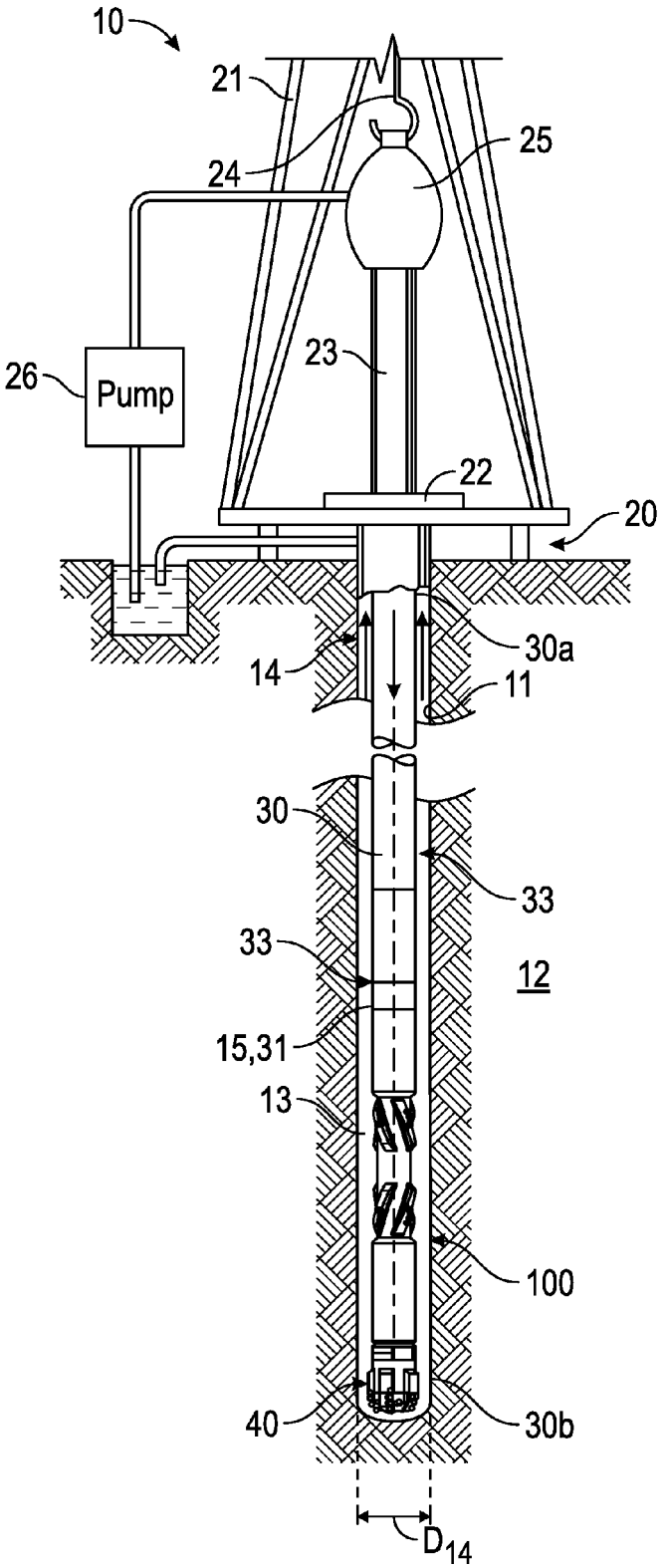
FIG. 1 is a schematic view of an embodiment of a drilling system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, an embodiment of a drilling system 10 is schematically shown. In this embodiment, drilling system 10 includes a drilling rig 20 positioned over a borehole 11 penetrating a subsurface formation 12, a casing 14 extending from the surface into the upper portion of borehole 11, and a drillstring 30 suspended in borehole 11 from a derrick 21 of rig 20. Casing 14 has a central or longitudinal axis 15 and an inner diameter $D_{14}$. Drillstring 30 has a central or longitudinal axis 31, a first or uphole end 30*a* coupled to derrick 21, and a second or downhole end 30*b* opposite end 30*a*. In addition, drillstring 30 includes a drill bit 40 at downhole end 30*b*, a downhole cutting tool 100, axially adjacent bit 40, and a plurality of pipe joints 33 extending from cutting tool 100 to uphole end 30*a* . Pipe joints 33 are connected end-to-end, and tool 100 is connected end-to-end with the lowermost pipe joint 33 and bit 40. A bottomhole assembly (BHA) can be disposed in drillstring 30 proximal the bit 40 (e.g., axially between bit 40 and tool 100).

In this embodiment, drill bit 40 is rotated by rotation of drillstring 30 from the surface. In particular, drillstring 30 is rotated by a rotary table 22 that engages a kelly 23 coupled to uphole end 30*a* of drillstring 30. Kelly 23, and hence drillstring 30, is suspended from a hook 24 attached to a traveling block (not shown) with a rotary swivel 25 which permits rotation of drillstring 30 relative to derrick 21. Although drill bit 40 is rotated from the surface with drillstring 30 in this embodiment, in general, the drill bit (e.g., drill bit 40) can be rotated with a rotary table or a top drive, rotated by a downhole mud motor disposed in the BHA, or combinations thereof (e.g., rotated by both rotary table via the drillstring and the mud motor, rotated by a top drive and the mud motor, etc.). For example, rotation via a downhole motor may be employed to supplement the rotational power of a rotary table 22, if required, and/or to effect changes in the drilling process. Thus, it should be appreciated that the various aspects disclosed herein are adapted for employment in each of these drilling configurations and are not limited to conventional rotary drilling operations.

During drilling operations, a mud pump 26 at the surface pumps drilling fluid or mud down the interior of drillstring 30 via a port in swivel 25. The drilling fluid exits drillstring 30 through ports or nozzles in the face of drill bit 40, and then circulates back to the surface through the annulus 13 between drillstring 30 and the sidewall of borehole 11. The drilling fluid functions to lubricate and cool drill bit 40, and carry formation cuttings to the surface.

Figure 2:
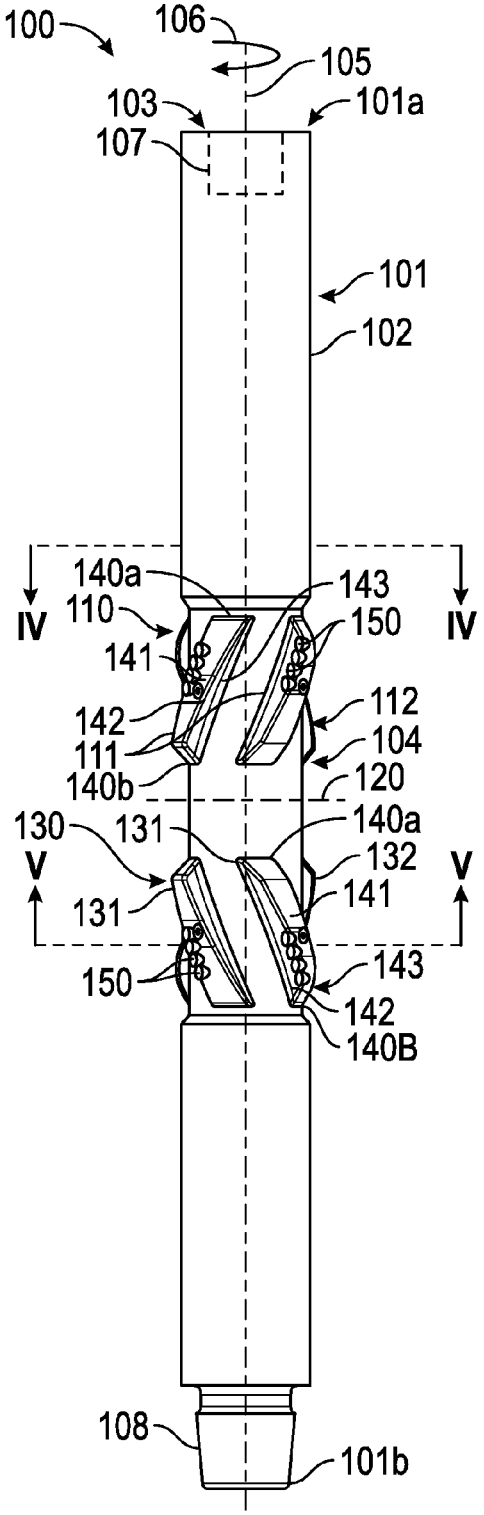
FIG. 2 is a front side view of the downhole cutting tool of FIG. 1.
Figure 3:
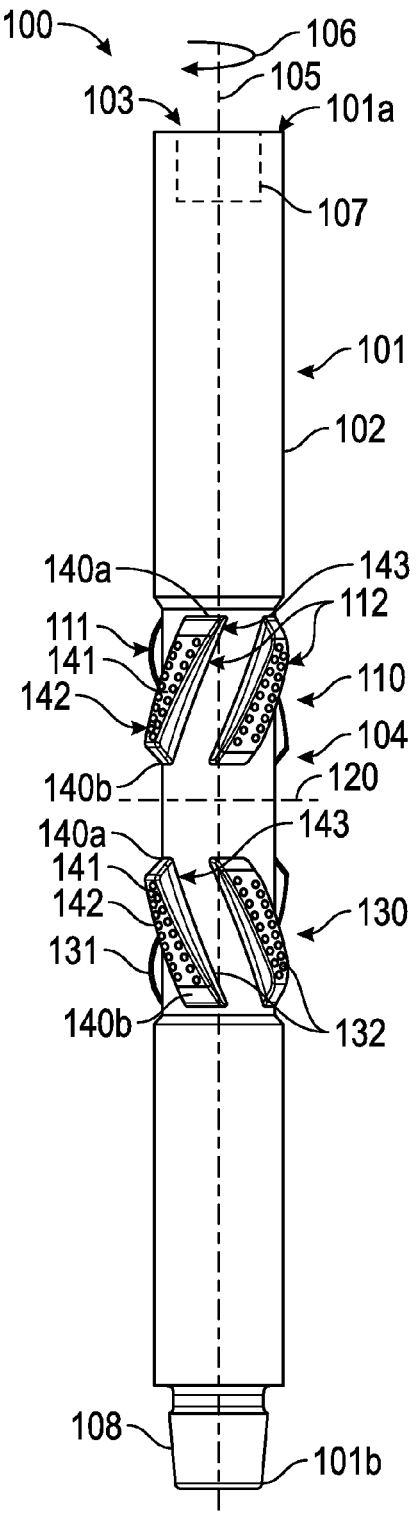
FIG. 3 is a back side view the downhole cutting tool of FIG. 1.

Referring now to FIGS. 2 and 3, downhole cutting tool 100 is shown. As will be described in more detail below, tool 100 functions to ream borehole 11 as drill bit 40 drills the borehole 11. In this embodiment, downhole cutting tool 100 includes an elongate tubular body 101, a first or uphole eccentric reamer section 110, and a second or downhole eccentric reamer section 130 axially spaced below the uphole reamer section 110. Tubular body 101 has a central or longitudinal axis 105 coincident with drillstring axis 31 (not shown in FIGS. 2 and 3), a first or uphole end 101*a*, a second or downhole end 101*b* opposite the uphole end 101*a*, a generally cylindrical outer surface 102 extending axially between ends 101*a, b*, and an inner through bore 103 extending axially between ends 101*a, b*. Bore 103 allows for the passage of drilling fluid through tool 100 in route to bit 40 (not shown in FIGS. 2 and 3). During drilling operations, tool 100 is rotated about axis 105 in a cutting direction 106.

Outer surface 102 of body 101 includes an annular cylindrical recess 104 axially disposed between the ends 101*a, b*. Thus, the diameter of outer surface 102 is reduced within recess 104. In this embodiment, recess 104 is axially equidistant from each ends 101*a, b*. In this embodiment, downhole end 101*b* comprises a male pin-end 108 that connects to a mating female box-end of drill bit 40, and uphole end 101*a* comprises a female box-end 107 that connects to a mating male pin-end at the lower end of the lowermost pipe joint 33.

Referring now to FIGS. 2-5, each reamer section 110, 130 includes a plurality of circumferentially-spaced helical blades 111, 112 and 131, 132, respectively, extending radially outward from recess 104. In this embodiment, blades 111, 112, 131, 132 are integrally formed as a part of tool body 101. In other words, blades 111, 112, 131, 132 and body 101 are a unitary single-piece. As will be described in more detail below, blades 111, 131 are designed to cut and shear the sidewall of borehole 11, while blades 112, 132 generally function as stabilizing bearing surfaces during rotation inside of the casing 14.

Figure 4:
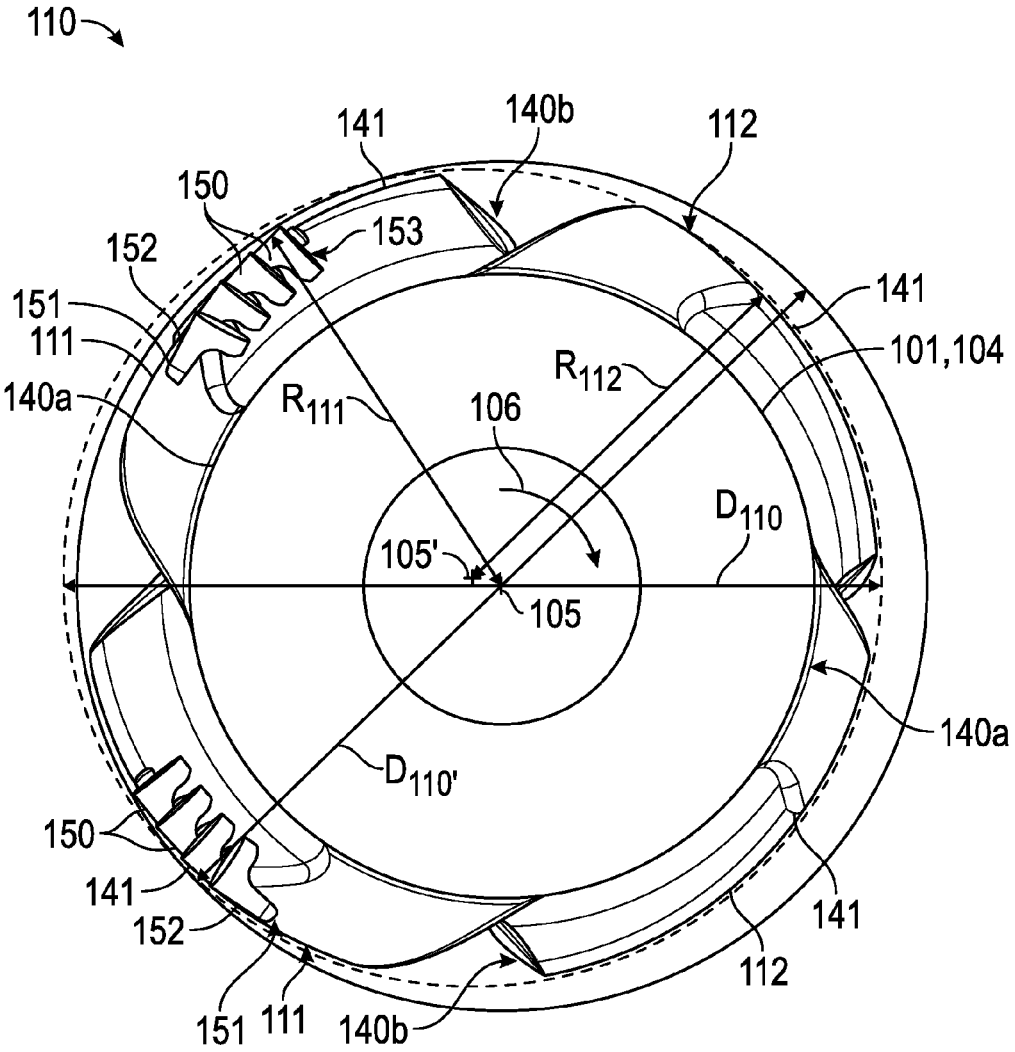
FIG. 4 is a cross-sectional top view of the downhole cutting tool of FIG. 2 taken along section IV-IV and illustrating the uphole reamer section.
Figure 5:
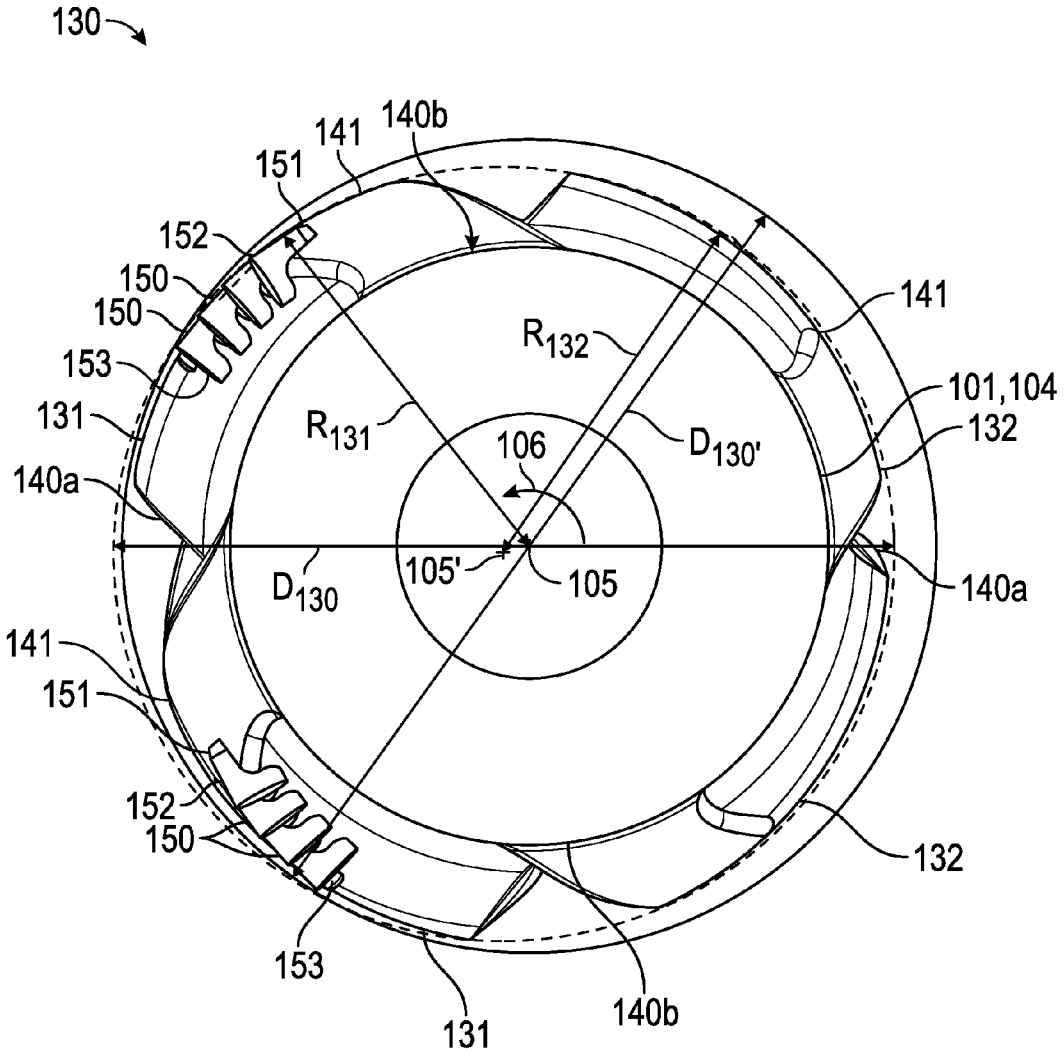
FIG. 5 is a cross-sectional bottom view of the downhole cutting tool of FIG. 2 taken along section V-V and illustrating the lower reamer section.

As best shown in FIGS. 4 and 5, in this embodiment, uphole reamer section 110 includes four parallel blades—a pair of blades 111 and a pair of blades 112; and downhole reamer section 130 includes four parallel blades—a pair of blades 131 and a pair of blades 132. In this embodiment, blades 111, 112 of uphole reamer section 110 are uniformly circumferentially-spaced about body 101, and blades 131, 132 of downhole reamer section 130 are uniformly circumferentially-spaced about body 101. Thus, the four total blades 111, 112 are angularly spaced 90° apart about axis 105, and the four total blades 131, 132 are angularly spaced 90° apart about axis 105. In addition, blades 111, 112 are arranged such that blades 111 are circumferentially adjacent each other and blades 112 are circumferentially adjacent each other. Thus, each blade 111 is angularly spaced 180° from one blade 112. Likewise, blades 131, 132 are arranged such that blades 131 are circumferentially adjacent each other and blades 132 are circumferentially adjacent each other. Thus, each blade 131 is angularly spaced 180° from one blade 132.

Referring again to FIGS. 2 and 3, each blade 111, 112, 131, 132 has a first or uphole end 140*a*, a second or downhole end 140*b*, a formation-facing surface 141, a forward-facing or leading surface 142, and a generally rear-facing or trailing surface 143. Each surface 141, 142, 143 extends between ends 140*a, b* of the corresponding blade 111, 112, 131, 132. Surfaces 141 are radially spaced from outer surface 102 and face the sidewall of borehole 11 during drilling operations, and surfaces 142, 143 extend radially from outer surface 102 to surface 141. Surfaces 142 are termed "forward-facing" or "leading" as they lead the corresponding blade 111, 112, 131, 132 relative to the cutting direction of rotation 106; and surfaces 143 are termed "rear-facing" or "trailing" as they trail the corresponding blade 111, 112, 131, 132 relative to the cutting direction of rotation 106. In addition, blades 111, 131 are generally circumferentially aligned and blades 112, 132 are generally circumferentially aligned. More specifically, downhole end 140*b* of each blade 111, 112 is circumferentially aligned with uphole end 140*a* of one blade 131, 132, respectively, and uphole end 140*a* of each blade 111, 112 is circumferentially aligned with downhole end 140*b* of one blade 131, 132, respectively.

Referring still to FIGS. 2 and 3, blades 111, 112, 131, 132 extend generally helically about tool body 101, and as previously described, blades 111, 112 are parallel to each other and blades 131, 132 are parallel to each other. However, blades 111, 112 are not parallel to blades 131, 132—blades 111, 112 and blades 131, 132 extend helically in opposite directions about tool body 101. In particular, downhole end 140*b* of each blade 111, 112 of uphole reamer section 110 leads the blade 111, 112 relative to the cutting direction of rotation 106, whereas uphole end 140*a* of each blade 131, 132 of downhole reamer section 130 leads the blade 131, 132 relative to the cutting direction of rotation 106.

As best shown in FIGS. 4 and 5, formation facing surface 141 of each blade 111, 131, is disposed at an outer radius $R_{111}$ and $R_{131}$, respectively, measured radially from axis 105, to the formation facing surface 141. Further, the formation facing surface 141 of each blade 112, 132 is disposed at an outer radius $R_{112}$, $R_{132}$, respectively, measured radially from an axis 105', which is parallel to and radially offset from the central axis 105 of tool 100, to the formation facing surface 141. In addition, blades 111, 112 of uphole reamer section 110 taper or incline radially inward moving from downhole end 140*b* to uphole end 140*a*, and blades 131, 132 of downhole reamer section 130 taper or incline radially inward moving from uphole end 140*a* to downhole end 140*b*. Thus, radius $R_{111}$, $R_{112}$ of formation facing surface 141 of each blade 111, 112, respectively, decreases moving from downhole end 140*b* to uphole end 140*a*, and radius $R_{131}$, $R_{132}$ of formation facing surface 141 of each blade 131, 132, respectively, decreases moving from uphole end 140*a* to downhole end 140*b*. Consequently, radius $R_{111}$, $R_{112}$ of formation facing surface 141 of each blade 111, 112, respectively, is at a maximum at downhole end 140*b* and at a minimum at uphole end 140*a*, whereas radius $R_{131}$, $R_{132}$ of formation facing surface 141 of each blade 131, 132, respectively, is at a maximum at uphole end 140*a* and at a minimum at downhole end 140*b*.

For purposes of clarity and further explanation, the maximum radius $R_{111}$, $R_{112}$ of formation facing surface 141 of each blade 111, 112, respectively, (i.e., the radius $R_{111}$, $R_{112}$ at each downhole end 140*b*) is referred to as radius $R_{111max}$, $R_{112max}$, respectively; and the maximum radius $R_{131}$, $R_{132}$ of formation facing surface 141 of each blade 131, 132, respectively, (i.e., the radius $R_{131}$, $R_{132}$ at each uphole end 140*a*) is referred to as radius $R_{131max}$, $R_{132max}$, respectively. In this embodiment, each radius $R_{111max}$ and each radius $R_{131max}$ is the same, and each radius $R_{112max}$ and each radius $R_{132max}$ is the same. Still further, each radius $R_{111max}$, $R_{131max}$ is greater than each radius $R_{112max}$, $R_{132max}$. Since each radius $R_{111max}$ is greater than each radius $R_{112max}$, and blades 111, 112 are arranged with blades 111 circumferentially adjacent and blades 112 circumferentially adjacent, uphole reamer section is eccentric relative to axis 105; and since each radius $R_{131max}$ is greater than each radius $R_{132max}$, and blades 131, 132 are arranged with blades 111 circumferentially adjacent and blades 112 circumferentially adjacent, downhole reamer section is also eccentric relative to axis 105.

Referring again to FIGS. 2-5, each reamer section 110, 130 includes a plurality of cutter elements 150 mounted to the formation facing surface 141 of each blade 111, 131. In particular, on each blade 111, 131, cutter elements 150 are arranged adjacent one another in row along the leading edge of the blade 111, 131 (i.e., along the intersection of surfaces 141, 142). On blades 111 of uphole reamer section 110, cutter elements 150 are positioned proximal uphole ends 140*a*; and on blades 131 of downhole reamer section 130, cutter elements 150 are positioned proximal downhole ends 140*b*. In particular, cutter elements 150 on blades 111 are axially positioned side-by-side along the upper half of each blade 111, and cutter elements 150 on blades 131 are axially positioned side-by-side along the lower half of each blade 131.

In general, each cutter element 150 can be any suitable type of cutter element known in the art. In this embodiment, each cutter element 150 comprises an elongate cylindrical tungsten carbide support member 151 and a hard polycrystalline diamond (PD) cutting layer 152 bonded to the end of the support member 151. Support member 151 of each cutter element 150 is received and secured in a pocket formed in surface 141 of the corresponding blade 111, 131 with cutting layer 152 exposed on one end. Each cutting layer 152 has a generally forward-facing cutting face 153 relative to the cutting direction of rotation 106. In this embodiment, cutting faces 153 are substantially planar, but may be convex or concave in other embodiments.

Each cutting face 153 extends to an extension height measured radially from the corresponding formation-facing surface 141 to the radially outermost tip of the cutting face 153. In this embodiment, the extension height of each cutting face 153 is the same. However, since the radii $R_{111}$ of formation facing surfaces 141 of blades 111 decrease moving from downhole ends 140*b* to uphole ends 140*a*, the radii to which cutting faces 153 mounted to blades 111 extend relative to axis 105' progressively decrease moving toward uphole end 140*a*. Likewise, since the radii $R_{131}$ of formation facing surfaces 141 of blades 131 decrease moving from uphole end 140*a* to downhole end 140*b*, the radii to which cutting faces 153 mounted to blades 131 extend relative to axis 105' progressively decrease moving toward downhole end 140*b*. In this embodiment, the lowermost cutting face 153 mounted to each blade 111 extends to a radius equal to radius $R_{111max}$, with the remaining cutting faces 153 mounted to each blade 111 extending to radii that progressively decrease moving towards uphole end 140*a*; and the uppermost cutting face 153 mounted to each blade 131 extends to a radius equal to radius $R_{131max}$, with the remaining cutting faces 153 mounted to each blade 131 extending to radii that progressively decrease moving towards downhole end 140*b*.

As previously described, radii $R_{111max}$, $R_{131max}$ of blades 111, 131, respectively, are greater than radii $R_{112max}$, $R_{132max}$ of blades 112, 132, respectively, and further, blades 111, 131 include cutter elements 150 mounted thereto for reaming the sidewall of borehole 11. Thus, blades 111, 131 may also be referred to as "cutting" blades. Radii $R_{112max}$, $R_{132max}$ of blades 112, 132, respectively, are less than radii $R_{111max}$, $R_{131max}$ of blades 111, 131, respectively, blades 112, 132 do not include any cutter elements (e.g., cutter elements 150), and blades 112, 132 generally function as a stabilizing bearing surface during rotation inside of the casing. Thus, blades 112, 132 may also be referred to as "stabilizing" blades.

As best shown in FIG. 4, uphole reamer section 110 has a minimum pass through diameter $D_{110}$, which represents the minimum diameter hole or bore through which uphole reamer section 110 can be tripped, and as best shown in FIG. 5, downhole reamer section 130 has a minimum pass through diameter $D_{130}$, which represents the minimum diameter hole or bore through which downhole reamer section 130 can be tripped. Referring again to FIGS. 2-5, in this embodiment, due to the positioning, orientation, and configuration of blades 111, 112, 131, 132 (e.g., blades 111, 131 are circumferentially aligned; blades 112, 132 are circumferentially aligned; radii $R_{111max}$, $R_{131max}$ are the same and measured relative to the same axis 105; and radii $R_{112max}$, $R_{132max}$ are the same and measured relative to the same axis 105') and associated cutter elements 150, uphole reamer section 110 and downhole reamer section 130 are mirror images of each other across a reference plane 120 positioned midway between reamer sections 110, 130 and oriented perpendicular to axes 105, 105'. Consequently, pass through diameters $D_{110}$, $D_{130}$ are the same and are concentrically aligned such that both reamer sections 110, 130 can simultaneously pass through casing 14 having inner diameter $D_{14}$ equal to or greater than pass through diameters $D_{110}$, $D_{130}$. In other words, if inner diameter $D_{14}$ of casing 14 is equal to or greater than pass through diameters $D_{110}$, $D_{130}$, then reamer sections 110, 130, respectively, can pass therethrough. However, if inner diameter $D_{14}$ of casing is less than pass through diameters $D_{110}$, $D_{130}$, then reamer sections 110, 130, respectively, cannot pass therethrough.

Referring again to FIGS. 4 and 5, when uphole reamer section 110 is rotated in cutting direction 106 about axis 105, it cuts or reams a hole to a reaming diameter $D_{110'}$, and when lower reamer section 130 is rotated in cutting direction 106 about axis 105, it cuts or reams a hole to a reaming diameter $D_{130'}$. Reaming diameter $D_{110'}$ is greater than pass through diameter $D_{110}$, thereby enabling uphole reamer section 110 to ream borehole 11 to diameter $D_{110'}$ that is greater than the pass through diameter $D_{110}$. Similarly, reaming diameter $D_{130'}$ is greater than pass through diameter $D_{130}$, thereby enabling downhole reamer section 130 to ream borehole 11 to diameter $D_{130'}$ that is greater than pass through diameter $D_{130}$. In embodiments described herein, each reaming diameter $D_{110'}$, $D_{130'}$ is preferably greater than each pass through diameter $D_{110}$, $D_{130}$, respectively; more preferably each reaming diameter $D_{110'}$, $D_{130'}$ greater than each pass through diameter $D_{110}$, $D_{130}$, respectively, and less than 112% of each pass through diameter $D_{110}$, $D_{130}$, respectively; and even more preferably each reaming diameter $D_{110'}$, $D_{130'}$ is greater than each pass through diameter $D_{110}$, $D_{130}$, respectively, and less than 105% of each pass through diameter $D_{110}$, $D_{130}$, respectively.

Although stabilizing blades 112, 132 do not include any cutter elements 150 in this embodiment, in other embodiments, one or more cutter elements 150 can be mounted to formation facing surface 141 of one or more of the stabilizing blades 112 proximal uphole end 140*a*, and one or more cutter elements 150 can be mounted to formation facing surface 141 of one or more of the stabilizing blades 132 proximal downhole end 140*b*. However, such cutter elements 150 mounted to blades 112, 132 do not extend radially beyond radii $R_{112max}$, $R_{132max}$ of blades 112, 132, respectively.

Although each reamer section 110, 130 has been shown and described as having four blades (i.e., uphole reamer section 110 includes two cutting blades 111 and two stabilizing blades 112; and downhole reamer section 130 includes two cutting blades 131 and two stabilizing blades 132), in general, the total number of blades (e.g., blades 111, 112, 131, 132) on each reamer section (e.g., reamer sections 110, 130) can be more or less than four. For example, in some embodiments, each reamer section includes five or six helical blades instead of four. However, regardless of the total number of blades on each reamer section, the blades on each reamer section are preferably uniformly circumferentially-spaced. In addition, in embodiments where there is an odd number of total blades on a reamer section, there is preferably at least one more cutting blade than stabilizing blade.

Figure 6:
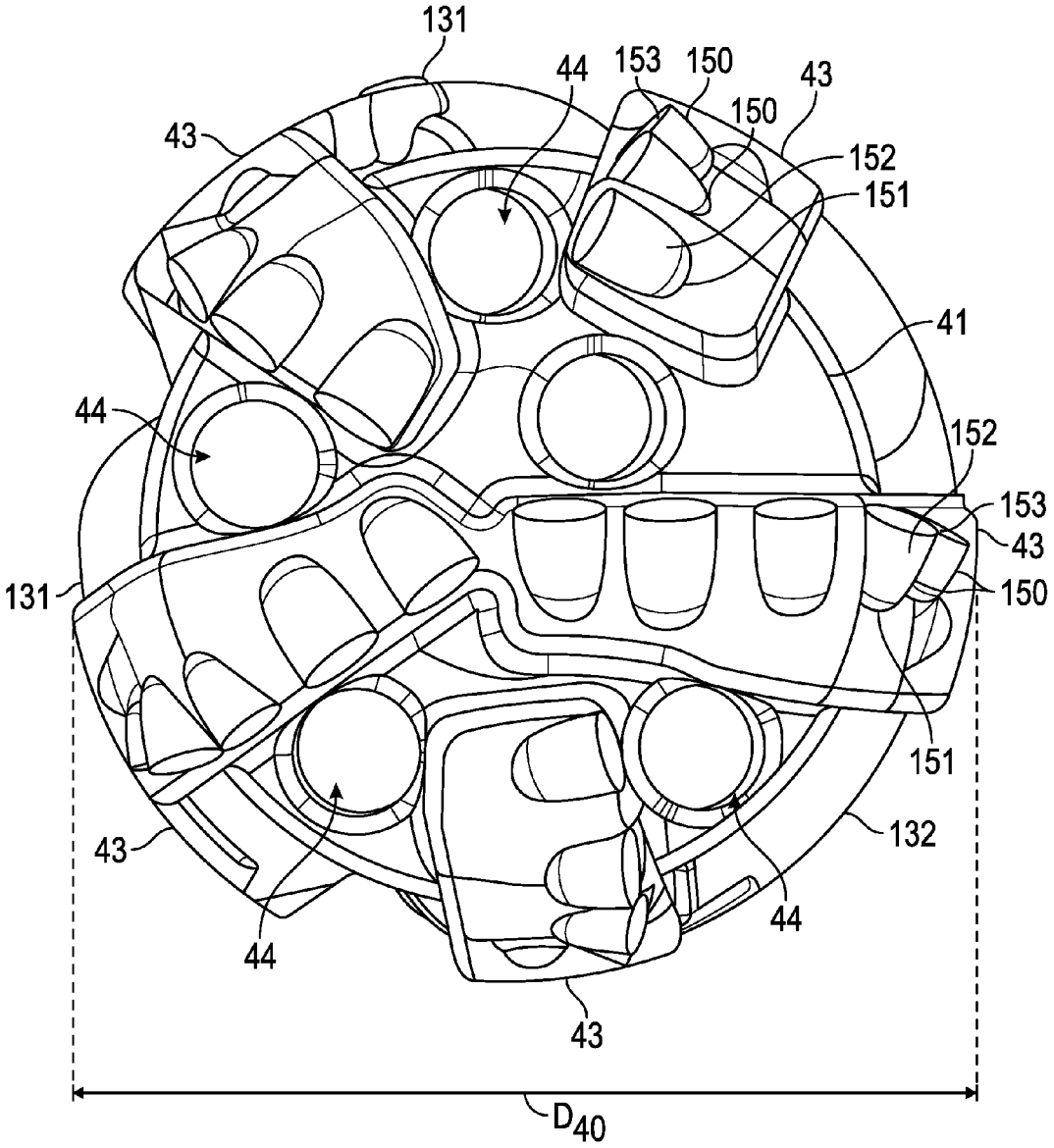
FIG. 6 is a bottom view of the drill bit and downhole cutting tool of FIG. 1.
Figure 7:
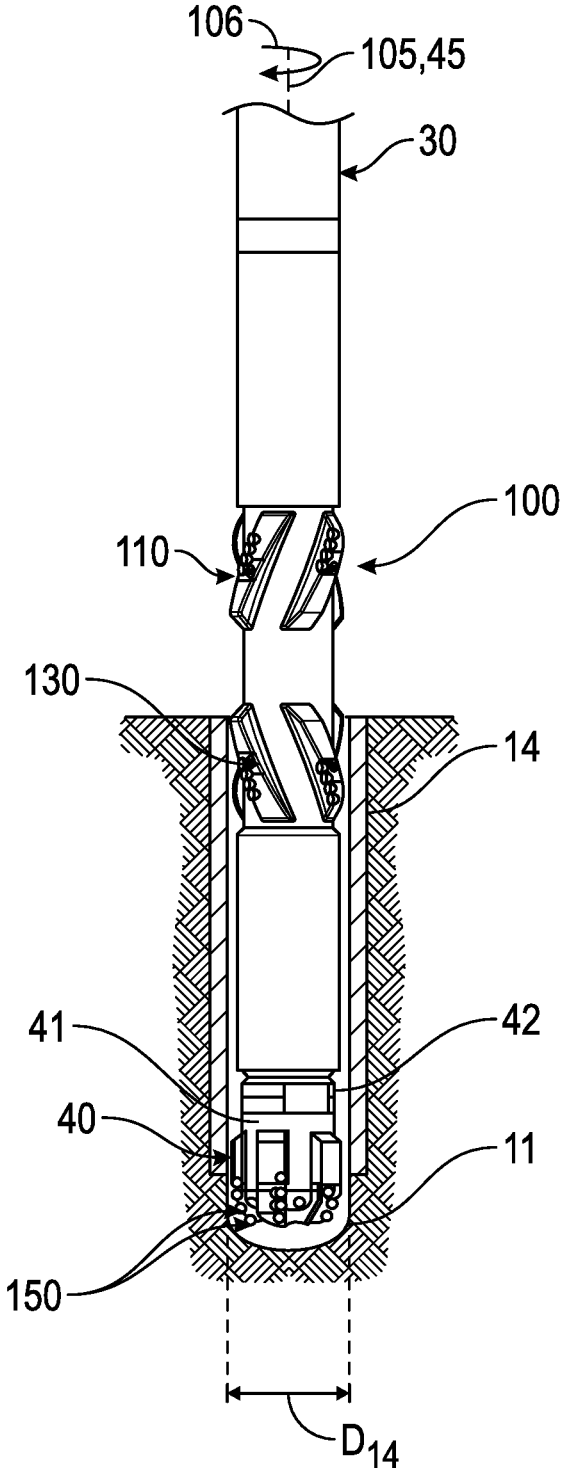
FIG. 7 is an enlarged partial view of the system of FIG. 1 illustrating the drill bit and the cutting tool being lowered through the casing at the upper end of the borehole.

Referring now to FIGS. 6 and 7, drill bit 40 is connected to downhole end 101*b* of tool body 101 and has a central axis 45 coaxially aligned with axis 105, a bit body 41, and a shank 42. During drilling operations, bit 40 is rotated about axis 45 in cutting direction 106 previously described. In this embodiment, bit 40 is a fixed cutter bit including a plurality of blades 43 extending along the outside of body 41. A plurality of cutter elements 150 as previously described are disposed side-by-side along the leading edge of each blade 43 such that each cutting face 153 is generally forward-facing relative to the cutting direction of rotation 106. Bit 40 has a maximum or full gage diameter $D_{40}$ defined by the radially outermost reaches of blades 43 and cutter elements 150. In this embodiment, full gage diameter $D_{40}$ of bit 40 is greater than the pass through diameter $D_{110}$, $D_{130}$ of each reamer section 110, 130, respectively and less than the reaming diameter $D_{110'}$, $D_{130'}$ of each reamer section 110, 130, respectively. A plurality of ports or nozzles 44 are disposed in body 41 and are configured to allow the flow of drilling fluids (e.g., drilling mud) therethrough during drilling operations to lubricate and cool drill bit 40, and to carry formation cuttings to the surface.

Referring now to FIG. 7, during drilling operations, tool 100 and drill bit 40 are rotated in cutting direction 106. With WOB applied, bit 40 engages and cuts the formation. As chips of the formation are broken off and transported to the surface with drilling mud, bit 40 advances along a predetermined trajectory to lengthen borehole 11. During the initial stages of drilling immediately below casing 14, tool 100 is disposed within casing 14 and is rotated with string 30 to rotate bit 40. With most conventional eccentric reamers, rotation of the reamer within casing (e.g., casing 14) is generally discouraged as the reamer may undesirably cut and damage the casing, potentially comprising the integrity of the well. In particular, most eccentric reamers are sized such that they can be advanced axially through the casing, and then ream the borehole to a diameter greater than the diameter of the casing. To maximize the diameter of the reamed borehole, conventional reamers are typically sized as large as possible while being able to be advanced through the casing. Consequently, when such an eccentric reamer is rotated within the casing, it may ream the inside of the casing to a diameter greater than the inner diameter of the casing itself, thereby potentially damaging the casing. However, in embodiments described herein, reamer sections 110, 130 are configured such that they can be rotated within casing 14 without posing a significant risk of damage to casing 14.

Figure 8:
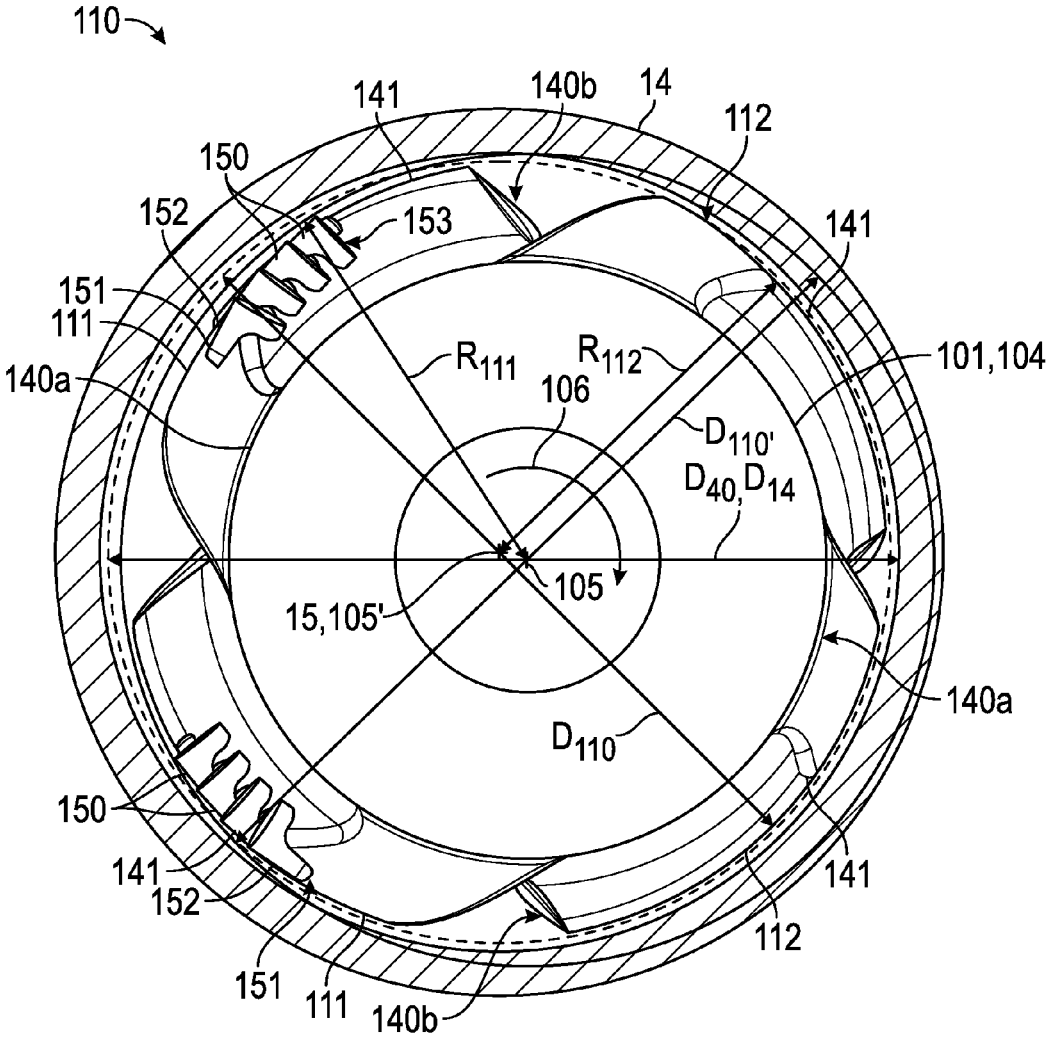
FIG. 8 is a bottom view of the lower reamer section of FIG. 7 in the casing.

As best shown in FIG. 8, reamer sections 110, 130 are sized as large as possible while still being able to pass through casing 14—pass through diameters $D_{110}$. $D_{130}$ are equal to or slightly less than the inner diameter $D_{14}$ of casing 14. It should be appreciated that even though FIG. 8 only shows the upper reamer section 110 within casing 14, lower reamer section 130 functions in the same manner. Due to the eccentricity of reamer sections 110, 130, when tool 100 is disposed in casing 14, central axis 105 of tool 100 is radially offset from central axis 15 of casing 14 and axis 105' is coaxially aligned with axis 15 of casing 14. As previously described, if tool 100 is permitted to rotate in cutting direction 106 about tool axis 105, reamer sections 110, 130 will ream the inside of casing 14 to diameters $D_{110}$, $D_{130}$. However, within casing 14, reamer sections 110, 130 do not rotate about axis 105; within casing 14, reamer sections 110, 130 are forced to rotate about aligned axes 15, 105'. More specifically, cutting elements 150 are mounted to the blade's 111 distal leading ends 140*b* disposed at radius $R_{111max}$, and cutting elements 150 are mounted to the blade's 131 distal leading ends 140*a* disposed at radius $R_{131max}$. Engagement of the smooth formation facing surfaces 141 disposed at radii $R_{111max}$, $R_{131max}$ at leading ends 140*b*, 140*a*, respectively, with the smooth inner cylindrical surface of casing 14 continuously forces reamer sections 110, 130 to rotate about axes 15, 105' and prevents cutting faces 153 from cutting into casing 14. Since eccentric reamer sections 110, 130 are forced to rotate about axes 15 of casing 14, the rotational diameter of reamer sections 110, 130 within casing 14 are equal to pass through diameters $D_{110}$, $D_{130}$, thereby enabling tool 100 and reamer sections 110, 130 to pass axially through casing 14 while being rotated and without reaming or damaging casing 14.

Referring now to FIGS. 1 and 7, once bit 40 has sufficiently advanced, tool 100 exits the lower end of casing 14. Once tool 100 is clear of casing 14, formation facing surfaces 141 on the leading ends 140*b*, 140*a* of blades 111, 131, respectively, no longer slidingly engage the smooth cylindrical inner surface of casing 14, and thus, reamer sections 110, 130 are no longer forced to rotate about casing axes 15, 105'. Rather, once tool 100 is clear of casing 14, reamer sections 110, 130 rotate about tool axis 105, thereby enabling reamer sections 110, 130 to ream borehole 11 to diameter $D_{110'}$, $D_{130'}$, which is greater than diameters $D_{14}$, $D_{110}$, $D_{130}$. When drilling new sections of borehole 11 (i.e., during advancement of tool 100 through borehole 11), downhole reamer section 130 leads uphole reamer section 110 and functions as the primary reamer, whereas when tripping tool 100 out of borehole 11 (i.e., during retraction of tool 100 from borehole 11), uphole reamer section 110 leads downhole reamer section 110 and functions as the primary reamer. Cutter elements 150 of downhole reamer section 130 are disposed proximal lower ends 140*b* of blades 131, and extend to progressively increasing radii moving axially from downhole ends 140*b* toward uphole ends 140*a* of blades 131; and cutter elements 150 of uphole reamer section 110 are disposed proximal uphole ends 140*a* of blades 111, and extend to progressively increasing radii moving axially from uphole ends 140*a* toward lower ends 140*b* of blades 111. Thus, when drilling new sections of borehole 11, tool 100 is rotated in cutting direction 106 about axis 105 and downhole reamer section 130 leads uphole reamer section 110, and more specifically, downhole ends 140*b* lead blades 131 as tool 100 advances axially through borehole 11, thereby enabling cutter elements 150 mounted to blades 131 to progressively increase the diameter of borehole 11 to diameter $D_{130'}$ as downhole reamer section 130 advances through borehole 11. When tripping tool 100 out of borehole 11, tool 100 is rotated in cutting direction 106 about axis 105 and uphole reamer section 110 leads downhole reamer section 130, and more specifically, uphole ends 140*a* lead blades 111 as tool 100 advances axially through borehole 11, thereby enabling cutter elements 150 mounted to blades 111 to progressively increase the diameter of borehole 11 to diameter $D_{110'}$ as uphole reamer section 110 advances through borehole 11. In the manner described, tool 100 and reamer sections 110, 130 can be rotated within casing 14 without cutting or damaging casing 14 and ream borehole 11 to a diameter $D_{110'}$, $D_{130'}$ that is greater than the inner diameter $D_{14}$ of casing. Within casing 14, reamer sections 110, 130 are forced to rotate about axis 15 of casing 14, however, once sections 110, 130 are clear of casing 14, reamer sections 110, 130 rotate about axis 105 of tool 100. In addition, tool 100 and reamer sections 110, 130 can ream borehole 11 while drilling new sections of borehole 11 and while tripping tool 100 out of borehole 11. Furthermore, reamer sections 110, 130 can be used in connection with a drill bit (e.g., bit 40) that is being rotated exclusively by a mud motor. Specifically, because the pass through diameters $D_{110}$, $D_{130}$ of the reamer sections 110, 130, respectively, are slightly less than the diameter of the drill bit (e.g., diameter $D_{40}$ of drill bit 40) which is equal to or slightly less than the casing diameter (e.g., diameter $D_{14}$), reamer sections 110, 130 can pass through a borehole (e.g., borehole 11) that is being drilled by the bit (e.g., bit 40) without also rotating therein.

In the embodiment of tool 100 previously shown and described, reamer sections 110, 130 are axially spaced apart along a single body 101. However, in other embodiments, the reamer sections (e.g., reamer sections 110, 130) can be disposed on different tubulars, tools, or bodies. For example, the lower reamer section (e.g., reamer section 130) can be disposed on a first tubular body axially adjacent the drill bit (e.g., bit 40) and the uphole reamer section (e.g., reamer section 130) can be disposed on a second tubular body axially adjacent and coupled to the first tubular body. Still further, in drillstring 30 previously shown and described, bit 40 is a separate component that is removably coupled to tool 100 including reamer sections 110, 130. However, in other embodiments, the bit (e.g., bit 40) and one or both reamer sections (e.g., lower reamer section 110 or reamer sections 110, 130) can be integrally formed as a single component or tool. Moreover, although drill bit 40 coupled to reamer sections 110, 130 is a fixed cutter bit, in other embodiments, the reamer sections (e.g., reamer sections 110, 130) can be used in connection with different types of drill bit such as rolling cone drill bits. Also, in the embodiment of tool 100 previously shown and described, reamer sections 110, 130 are disposed within a recess 104 positioned along the outer surface 102 of body 101. However, in other embodiments, no such recess 104 may be included. Further, in other embodiments, the recess 104 may be included along the outer surface 102 of the body 101, but the recess 104 may not be equidistant from the ends 101*a*, 101*b*. Still further, although the upper end 101*a* of the body 101 of tool 100 has been shown and described as having a female box end 107, and the lower end 101*b* has been shown and described as having a male pin end 108, in other embodiments, the upper end 101*a* may have a male pin end and/or the lower end 101*b* may have a female box end. Moreover, in some embodiments, the drill bit 40 may have a male pin end type connector.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tool for reaming a borehole, the tool comprising:

a tubular body having a central axis, a first end, and a second end opposite the first end;

an uphole eccentric reamer section mounted to the tubular body, wherein the uphole eccentric reamer section is eccentric about the central axis of the tubular body;

a downhole eccentric reamer section mounted to the tubular body and axially positioned below the uphole eccentric reamer section, wherein the downhole eccentric reamer section is eccentric about the central axis of the tubular body;

wherein each eccentric reamer section includes a first blade extending radially from the tubular body, wherein the first blade of each eccentric reamer section has an uphole end and a downhole end axially positioned below of the uphole end, wherein the first blade of the uphole eccentric reamer section circumferentially overlaps with the first blade of the downhole eccentric reamer section;

wherein the first blade of the uphole eccentric reamer section extends helically about the tubular body in a first helical direction moving from the uphole end of the first blade of the uphole eccentric reamer section to the downhole end of the first blade of the uphole eccentric reamer section:

wherein the first blade of the downhole eccentric reamer section extends helically about the tubular body in a second helical direction moving from the uphole end of the first blade of the downhole eccentric reamer section to the downhole end of the first blade of the downhole eccentric reamer section;

wherein the second helical direction is opposite the first helical direction; and a cutter element mounted to the first blade of each eccentric reamer section;

wherein the cutter element mounted to the first blade of the uphole reamer section and the cutter element mounted to the first blade of the downhole reamer section are each configured to engage and ream the borehole.

2. The tool of claim 1, wherein the uphole eccentric reamer section includes a pass through diameter and is configured to ream a borehole to a diameter larger than the pass through diameter of the uphole eccentric reamer section when the tubular body is rotated about the central axis in a cutting direction;

wherein the downhole eccentric reamer section includes a pass through diameter and is configured to ream a borehole to a diameter that is larger than the pass through diameter of the downhole eccentric reamer section when the tubular body is rotated about the central axis in the cutting direction;

wherein each first blade has a formation-facing surface extending from the uphole end to the downhole end, and a forward-facing surface extending radially from the tubular body to the formation-facing surface;

wherein the formation facing surface of the first blade of the uphole eccentric reamer section is disposed at a radius R1 measured perpendicularly from the central axis, wherein the radius R1 increases moving from the uphole end to the downhole end of the first blade of the uphole eccentric reamer section;

wherein the formation facing surface of the first blade of the downhole eccentric reamer section is disposed at a radius R1' measured perpendicularly from the central axis, wherein the radius R1' decreases moving from the uphole end to the downhole end of the downhole eccentric reamer section; and wherein the cutter element of each first blade is mounted to the formation facing surface of the first blade of each eccentric reamer section, wherein the cutter element mounted to the first blade of the uphole eccentric reamer section extends to a radius relative to the central axis that is less than or equal to the radius R1 at the downhole end of the first blade of the uphole eccentric reamer section, and the cutter element mounted to the first blade of the downhole eccentric reamer section extends to a radius relative to the central axis that is less than or equal to the radius R1' at the uphole end of the first blade of the downhole eccentric reamer section.

3. The tool of claim 2, further comprising a plurality of cutter elements mounted to the formation facing surface of the first blade of each eccentric reamer section;

wherein the plurality of cutter elements mounted to the formation facing surface of the first blade of each eccentric reamer section includes the cutter element mounted to the formation facing surface of the first blade of the corresponding eccentric reamer section;

wherein the plurality of cutter elements mounted to the first blade of the uphole eccentric reamer section are arranged in a row proximal the uphole end of the first blade of the uphole eccentric reamer section;

wherein the plurality of cutter elements mounted to the first blade of the downhole eccentric reamer section are arranged in a row proximal the downhole end of the first blade of the downhole eccentric reamer section;

wherein each cutter element mounted to the first blade of the uphole eccentric reamer section extends to a radius relative to the central axis that is less than or equal to the radius R1 at the downhole end of the first blade of the uphole eccentric reamer section, and each cutter element mounted to the first blade of the downhole eccentric reamer section extends to a radius relative to the central axis that is less than or equal to the radius R1' at the uphole end of the first blade of the downhole eccentric reamer section.

4. The tool of claim 3, wherein the uphole eccentric reamer section includes a second blade circumferentially spaced from the first blade of the uphole eccentric reamer section;

wherein the downhole eccentric reamer section includes a second blade circumferentially spaced from the first blade of the downhole eccentric reamer section;

wherein the second blade of the uphole eccentric reamer section extends radially to a maximum radius R2 measured perpendicularly from a reamer axis that is parallel to and radially offset from the central axis, wherein the maximum radius R2 is less than the radius R1 at the downhole end of the first blade of the uphole eccentric reamer section; and wherein the second blade of the downhole eccentric reamer section extends radially to a maximum radius R2' measured perpendicularly from the reamer axis, wherein the maximum radius R2' is less than the radius R1' at the uphole end of the first blade of the downhole eccentric reamer section.

5. The tool of claim 4, wherein the first blade and the second blade of the uphole eccentric reamer section are uniformly circumferentially spaced about the central axis;

wherein the first blade and the second blade of the downhole eccentric reamer section are uniformly circumferentially spaced about the central axis;

wherein the first blade and the second blade of the uphole eccentric reamer section are oriented parallel to each other; and wherein the first blade and the second blade of the downhole eccentric reamer section are oriented parallel to each other.

6. The tool of claim 5, wherein each second blade includes an uphole end and a downhole end opposite the uphole end;

wherein the downhole end of each blade of the uphole eccentric reamer section leads the uphole end of the corresponding blade of the uphole eccentric reamer section relative to a cutting direction;

wherein the uphole end of the each blade of the downhole eccentric reamer section leads the downhole end of the corresponding blade of the downhole eccentric reamer section relative to the cutting direction.

7. The tool of claim 4, wherein the uphole eccentric reamer section includes another first blade that is circumferentially adjacent to the first blade of the uphole reamer section, such that the uphole reamer section includes a pair circumferentially adjacent first blades;

wherein the uphole eccentric reamer section also includes another second blade that is circumferentially adjacent to the second blade of the uphole eccentric reamer section, such that the uphole reamer section includes a pair of circumferentially adjacent second blades;

wherein the first blades and the second blades of the uphole eccentric reamer section are uniformly circumferentially spaced;

wherein the formation facing surface of each first blade of the uphole eccentric reamer section is disposed at the radius R1, wherein each radius R1 increases moving from the uphole end to the downhole end of the first blades of the uphole eccentric reamer section;

wherein each second blade of the uphole eccentric reamer section extends radially to a maximum radius R2 measured perpendicularly from the reamer axis, wherein each maximum radius R2 is less than the radius R1 at the downhole end of each first blade of the uphole eccentric reamer section;

wherein the downhole eccentric reamer section includes another first blade that is circumferentially adjacent to the first blade of the downhole eccentric reamer section, such that the uphole reamer section includes a pair circumferentially adjacent first blades;

wherein the downhole eccentric reamer section includes another second blade that is circumferentially adjacent to the second blade of the downhole eccentric reamer section, such that the downhole reamer section includes a pair of circumferentially adjacent second blades;

wherein the first blades and the second blades of the downhole eccentric reamer section are uniformly circumferentially spaced;

wherein the formation facing surface of each first blade of the downhole eccentric reamer section is disposed at the radius R1', wherein each radius R1' increases moving from the downhole end to the uphole end of each first blade of the downhole eccentric reamer section;

wherein each second blade of the downhole eccentric reamer section extends radially to a maximum radius R2' measured perpendicularly from the reamer axis, wherein each maximum radius R2' is less than the radius R1' at the uphole end of each first blade of the downhole eccentric reamer section.

8. The tool of claim 1, wherein a downhole end of the first blade of the uphole eccentric reamer section leads an uphole end of the first blade of the uphole eccentric reamer section relative to the cutting direction; and wherein an uphole end of the first blade of the downhole eccentric reamer section leads a downhole end of the first blade of the downhole eccentric reamer section relative to the cutting direction.

9. A system for drilling a borehole in an earthen formation, the system comprising:

a drillstring having a central axis, an uphole end, and a downhole end;

a drill bit disposed at the downhole end of the drillstring coaxially aligned with the drillstring, wherein the drill bit is configured to rotate about the central axis in a cutting direction to drill the borehole to a diameter D1;

a first eccentric reamer section mounted to the drillstring between the drill bit and the uphole end, wherein the first eccentric reamer section is eccentric about the central axis and is configured to rotate about the central axis in the cutting direction to ream the borehole to a diameter D2 that is greater than the diameter D1 and has a pass through diameter D2' that is smaller than the diameter D2;

a second eccentric reamer section mounted to the drillstring between the first eccentric reamer section and the uphole end of the drillstring, wherein the second eccentric reamer section is eccentric about the central axis and is configured to rotate about the central axis in the cutting direction to ream the borehole to a diameter D3 that is greater than the diameter D1 and has a pass through diameter that is smaller than the diameter D3;

wherein each eccentric reamer section includes a first blade, wherein the first blade of the first eccentric reamer section includes an uphole end and a downhole end opposite the uphole end, wherein the first blade of the first eccentric reamer section is configured to engage the borehole to ream the borehole to the diameter D2 when the first eccentric reamer section is rotated about the central axis in the cutting direction, wherein the first blade of the second eccentric reamer section includes an uphole end and a downhole end opposite the uphole end, wherein the first blade of the second eccentric reamer section is configured to engage the borehole to ream the borehole to the diameter D3 when the second eccentric reamer section is rotated about the central axis in the cutting direction, and wherein the first blade of the first eccentric reamer section circumferentially overlaps with the first blade of the second eccentric reamer section;

wherein the uphole end of the first blade of the first eccentric reamer section leads the downhole end of the first blade of the first eccentric reamer section relative to the cutting direction;

wherein the downhole end of the first blade of the second eccentric reamer section leads the uphole end of the first blade of the second eccentric reamer section relative to the cutting direction; and a cutter element mounted to the first blade of each of the first eccentric reamer section and the second eccentric reamer section;

wherein the cutter element has a forward-facing cutting face relative to the cutting direction.

10. The system of claim 9, wherein the first blade of the first eccentric reamer section has a formation-facing surface extending from the uphole end of the first blade of the first eccentric reamer section to the downhole end the first blade of the first eccentric reamer section;

wherein the first blade of the second eccentric reamer section has a formation-facing surface extending from the uphole end of the first blade of the second eccentric reamer section to the downhole end the first blade of the second eccentric reamer section;

wherein the formation facing surface of the first blade of the first eccentric reamer section is disposed at a radius R1' measured perpendicularly from the central axis, wherein the radius R1' decreases moving from the uphole end to the downhole end of the first blade of the first eccentric reamer section;

wherein the formation facing surface of the first blade of the second eccentric reamer section is disposed at a radius R1 measured perpendicularly from the central axis, wherein the radius R1 increases moving from the uphole end to the downhole end of the first blade of the second eccentric reamer section;

wherein the cutter element of the first blade of the first eccentric reamer section is mounted to the formation facing surface of the first blade of the first eccentric reamer section, and wherein the cutter element of the first blade of the second eccentric reamer section is mounted to the formation facing surface of the first blade of the second eccentric reamer section; and wherein the cutter element mounted to the first blade of the first eccentric reamer section extends to a radius relative to the central axis that is less than or equal to the radius R1' at the uphole end of each of the first blades of the first eccentric reamer section, and the cutter element mounted to the first blade of the second eccentric reamer section extends to a radius relative to the central axis that is less than or equal to the radius R1 at the downhole end of the first blade of the second eccentric reamer section;

wherein the first eccentric reamer section includes a second blade circumferentially spaced from the first blade of the first eccentric reamer section: and wherein the second eccentric reamer section includes a second blade circumferentially spaced from the first blade of the second eccentric reamer section.

11. The system of claim 10, wherein the first eccentric reamer section includes another first blade that is circumferentially adjacent to the first blade of the first reamer section, such that the first reamer section includes a pair circumferentially adjacent first blades;

wherein the first eccentric reamer section also includes another second blade that is circumferentially adjacent to the second blade of the first eccentric reamer section, such that the first reamer section includes a pair of circumferentially adjacent second blades;

wherein the first blades and the second blades of the first eccentric reamer section are uniformly circumferentially spaced with the first blades circumferentially adjacent each other and the second blades circumferentially adjacent each other;

wherein the second eccentric reamer section includes another first blade that is circumferentially adjacent to the first blade of the second reamer section, such that the second reamer section includes a pair circumferentially adjacent first blades;

wherein the second eccentric reamer section also includes another second blade that is circumferentially adjacent to the second blade of the second eccentric reamer section, such that the second reamer section includes a pair of circumferentially adjacent second blades;

wherein the first blades and the second blades of the second eccentric reamer section are uniformly circumferentially spaced with the first blades circumferentially adjacent each other and the second blades circumferentially adjacent each other;

wherein each of the first blades and the second blades of the first eccentric reamer section and the second eccentric reamer section has an uphole end, a downhole end, and a formation-facing surface extending from the uphole end to the downhole end;

wherein the formation facing surface of each first blade of the first eccentric reamer section is disposed at the radius R1', wherein the radius R1' decreases moving from the uphole end to the downhole end of the first blades of the first eccentric reamer section;

wherein the formation facing surface of each first blade of the second eccentric reamer section is disposed at the radius R1, wherein the radius R1 increases moving from the uphole end to the downhole end of the first blades of the second eccentric reamer section;

wherein each second blade of the first eccentric reamer section extends radially to a maximum radius R2' measured perpendicularly from a reamer axis that is parallel to and radially offset from the central axis, wherein the maximum radius R2' is less than the radius R1' at the downhole end of each first blade of the first reamer section;

wherein each second blade of the second eccentric reamer section extends radially to a maximum radius R2 relative to the reamer axis that is less than the radius R1 at the uphole end of each first blade of the second eccentric reamer section;

wherein each of the first blades of the first eccentric reamer section and the second eccentric reamer section further comprises a plurality of cutter elements mounted to the formation facing surface, wherein each cutter element in the first eccentric reamer section extends to a radius relative to the central axis that is less than or equal to the radius R1' at the uphole end of each first blade of the first reamer section, and wherein each cutter element in the second eccentric reamer section extends to a radius relative to the central axis that is less than or equal to the radius R1 at the downhole end of each first blade of the second reamer section.

12. The system of claim 9, wherein the second eccentric reamer section is a mirror image of the first eccentric reamer section across a reference plane positioned between the first eccentric reamer section and the second eccentric reamer section and oriented perpendicular to the central axis.

13. The system of claim 9, wherein the first blade of the first eccentric reamer section extends helically in a first helical direction moving from the uphole end of the first blade of the first eccentric reamer section to the downhole end of the first blade of the first eccentric reamer section;

wherein the first blade of the second eccentric reamer section extends helically in a second helical direction moving from the uphole end of the first blade of the second eccentric reamer section to the downhole end of the first blade of the second eccentric reamer section; and wherein the second helical direction is opposite the first helical direction.

14. The system of claim 13, wherein an uphole end of the first blade of the first eccentric reamer section is circumferentially aligned with a downhole end of the first blade of the second eccentric reamer section; and wherein a downhole end of the first blade of the first eccentric reamer section is circumferentially aligned with an uphole end of the first blade of the second eccentric reamer section.

15. The system of claim 14, wherein an uphole end of each second blade of the first eccentric reamer section is circumferentially aligned with a downhole end of one second blade of the second eccentric reamer section; and wherein a downhole end of each second blade of the first eccentric reamer section is circumferentially aligned with an uphole end of one second blade of the second eccentric reamer section.

16. The system of claim 9, wherein the diameter D2 is less than 112% of the pass through diameter D2'.

17. A tool for reaming a borehole, the tool comprising:

a tubular body having a central axis, a first end, and a second end opposite the first end;

an uphole eccentric reamer section mounted to the tubular body, wherein the uphole eccentric reamer section is eccentric about the central axis; and a downhole eccentric reamer section mounted to the tubular body and axially positioned below the uphole eccentric reamer section, wherein the downhole eccentric reamer section is eccentric about the central axis;

wherein each eccentric reamer section includes a first blade extending radially from the tubular body, wherein the first blade of the uphole eccentric reamer section extends about the tubular body along a right-handed helix about the central axis as viewed axially from the second end of the tubular body, wherein the first blade of the downhole eccentric reamer section extends about the tubular body along a left-handed helix about the central axis as viewed axially from the second end of the tubular body, and wherein the first blade of the uphole eccentric reamer section and the first blade of the downhole eccentric reamer section are each circumferentially disposed on a first side of the tubular body; and a cutter element mounted to the first blade of each eccentric reamer section;

wherein the cutter element of the first blade of the uphole reamer section and the cutter element of the first blade of the downhole reamer section are each configured to engage and ream the borehole when the tubular body is rotated about the central axis in a cutting direction.

18. The tool of claim 17, wherein the uphole eccentric reamer section includes a pass through diameter and is configured to ream the borehole to a diameter larger than the pass through diameter of the uphole eccentric reamer section when the tubular body is rotated in the cutting direction; and wherein the downhole eccentric reamer section includes a pass through diameter and is configured to ream the borehole to a diameter that is larger than the pass through diameter of the downhole eccentric reamer section when the tubular body is rotated in the cutting direction.

19. The tool of claim 17, wherein each eccentric reamer section includes a second blade extending radially from the tubular body, wherein the second blade of the uphole eccentric reamer section and the second blade of the downhole eccentric reamer section are circumferentially disposed on a second side of the tubular body that is radially opposite the first side of the tubular body; and wherein the first blade of the uphole eccentric reamer section extends radially to a radius R1 measured perpendicularly from the central axis, wherein the radius R1 increases moving from an uphole end to a downhole end of the first blade of the uphole eccentric reamer section;

wherein the first blade of the downhole eccentric reamer section extends radially to a radius R1' measured perpendicularly from the central axis, wherein the radius R1' decreases moving from an uphole end to a downhole end of the downhole eccentric reamer section;

wherein the second blade of the uphole eccentric reamer section extends radially to a maximum radius R2 measured perpendicularly from a reamer axis that is parallel to and radially offset from the central axis, wherein the maximum radius R2 is less than the radius R1 at the downhole end of the first blade of the uphole eccentric reamer section; and wherein the second blade of the downhole eccentric reamer section extends radially to a maximum radius R2' measured perpendicularly from the reamer axis, wherein the maximum radius R2' is less than the radius R1' at the uphole end of the first blade of the downhole eccentric reamer section.

* * * * *